US006189882B1

(12) United States Patent
Horiuchi et al.

(10) Patent No.: US 6,189,882 B1
(45) Date of Patent: Feb. 20, 2001

(54) IMAGING FORMING APPARATUS

(75) Inventors: Toshihiro Horiuchi, Nara; Toyoaki Nanba, Higashiosaka, both of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/064,752

(22) Filed: Apr. 23, 1998

(30) Foreign Application Priority Data

Apr. 25, 1997 (JP) ..... 9-108667

(51) Int. Cl.[7] ..... B65H 29/66

(52) U.S. Cl. ..... 271/65; 271/186; 271/288; 271/902

(58) Field of Search ..... 271/279, 302, 271/303, 65, 184, 185, 186, 902, 288; 270/58.23, 58.28

(56) References Cited

U.S. PATENT DOCUMENTS

| | | | | |
|---|---|---|---|---|
| 3,866,904 | * | 2/1975 | Stemmle | 271/65 X |
| 4,958,828 | * | 9/1990 | Saito | 271/186 X |
| 5,011,130 | | 4/1991 | Naito et al. | 271/288 |
| 5,082,272 | * | 1/1992 | Xydias et al. | 271/186 |
| 5,166,739 | | 11/1992 | Katsuki et al. | 379/401 |
| 5,215,298 | * | 6/1993 | Stemmle et al. | 271/186 X |
| 5,296,908 | * | 3/1994 | Hatano et al. | 271/186 X |
| 5,570,877 | * | 11/1996 | Asami et al. | 271/186 |
| 5,957,450 | * | 9/1999 | Kida et al. | 271/186 X |

FOREIGN PATENT DOCUMENTS

| | | |
|---|---|---|
| 5310357 | 11/1993 | (JP) . |
| 669862 | 9/1994 | (JP) . |

* cited by examiner

*Primary Examiner*—Christopher P. Ellis
*Assistant Examiner*—Patrick Mackey

(57) ABSTRACT

An object of the invention is to provide an image forming apparatus in which discharged sheets can be easily distinguished, and which has a reduced number of parts and can be economically produced. The apparatus has: a discharge tray unit which receives a sheet on which an image is formed; a fifth conveying path which guides a sheet from an image forming section to the discharge tray unit so as to place the sheet on the discharge tray unit with downward directing the image forming face; a first conveying path which guides the sheet from the image forming section to the discharge tray unit so as to place the sheet on the discharge tray unit with reversing the sheet to a direction opposite to the direction of the image forming face; and switching means for switching over the fifth conveying path and the first conveying path. The apparatus further has moving means for moving the discharge tray unit between a position where a sheet discharged from a discharge port of the fifth conveying path is received, and a second position where a sheet discharged from a discharge port of the first conveying path is received.

5 Claims, 6 Drawing Sheets

IMAGING FORMING APPARATUS

BACKGROUND OF THE INVENTION

1. Field of the Invention

The present invention relates to a mechanism for conveying a sheet on which an image is formed, to a discharge tray in an image forming apparatus such as a copier, a printer, a facsimile apparatus or the like.

2. Description of the Related Art

Conventionally, there is provided an image forming apparatus such as a copier or a printer, provided with reversing means which serves as a mechanism to reverse a sheet, in order to discharge the sheet processed by the image forming apparatus, with directing the front face of the sheet upward or downward, as disclosed in Japanese Unexamined Patent Publication JP-A 5-310357 (1993).

This image forming apparatus will be described with referring to FIG. 7. A main unit 81 of the image forming apparatus comprises: an exposing and reading section 82 which is disposed in an upper portion of the image forming apparatus main unit 81 and which reads an original; a scanning section 83 which is disposed under the exposing and reading section 82; a developing section 84 which is disposed under the scanning section 83; a sheet housing section 85 which is disposed under the developing section 84; and sheet discharging means 86 which is disposed to a side of the developing section 84 and the sheet housing section 85.

The sheet discharging means 86 includes a first discharge port 87 from which a sheet is discharged without being reversed, and a second discharge port 88 from which a sheet is discharged with being reversed. On the side of the image forming apparatus main unit 81, a first discharge tray 89 corresponding to the discharge port 87, and a second discharge tray 90 corresponding to the discharge port 88 are respectively disposed.

A sheet whose front face is directed upward is discharged to the first discharge tray 89, and a sheet whose back face is directed upward is discharged to the second discharge tray 90.

Another image forming apparatus is disclosed in Japanese Examined Patent Publication JP-B2 6-69862 (1994). In the image forming apparatus, as shown in FIG. 8, a sorter 92 is disposed to a side of an image forming apparatus main unit 91. The sorter 92 includes a non-sort discharge roller pair 93 which is not used in a sorting operation, and a sort discharge roller pair 94 which is used in a sorting operation. The sorter has a non-sort bin (discharge tray) 95 to which a sheet is discharged from the non-sort discharge roller pair 93, and sort bins (discharge trays) 96*a*, 96*b*, and 96*c* to which a sheet is discharged from the sort discharge roller pair 94.

A sheet which is not sorted is discharged to the non-sort bin 95, and a sheet which is sorted is discharged to the sort bin 96*a*, 96*b*, or 96*c*.

Even when front-face-discharged and back-face-discharged sheets are mixedly placed on the same single discharge tray, the user can easily distinguish the sheets based on the direction of their image forming faces, because front-face-discharged sheets are placed with upward directing their image forming faces and back-face-discharged sheets are placed with downward directing their image forming faces. Since the user usually removes non-sort-discharged sheets and sort-discharged sheets immediately after a discharging operation, provided that no sheet remains, there arises no problem even when a sheet is discharged after removing sheets.

In other words, even when sheets are discharged to discharge trays of the same kind, the sheets can be distinguished without producing any particular inconvenience. However, the provision of discharge trays of two kinds requires useless discharge trays, and increases the number of parts and the production cost.

In the discharge trays of two kinds, the distance between a discharge tray of one kind disposed in a lower position and a discharge tray of the other kind disposed in an upper position is limited. Therefore, the number of sheets which can be housed in the former discharge tray is restricted.

SUMMARY OF THE INVENTION

It is an object of the invention to provide an image forming apparatus in which discharged sheets can be easily distinguished, and which has a reduced number of parts and can be economically produced.

In a first aspect of the invention, an image forming apparatus comprises:

an image forming section for forming an image on a sheet;

a discharge tray for receiving the sheet on which an image is formed;

a first conveying path for guiding the sheet from the image forming section to the discharge tray so as to place the sheet on the discharge tray with directing an image forming face of the sheet in one of upward and downward directions;

a second conveying path for reversing the sheet to guide from the image forming section to the discharge tray so as to place the sheet on the discharge tray with directing the image forming face in the direction opposite to the direction in which the first conveying path guides the sheet to the discharge tray; and switching means for switching over the first conveying path and the second conveying path, and the apparatus further comprises moving means for moving the discharge tray between a position where a sheet discharged from a discharge port of the first conveying path is received, and another position where a sheet discharged from a discharge port of the second conveying path is received.

According to the first aspect of the invention, a sheet on which an image is formed is guided by the first or second conveying path and then discharged to the discharge tray. Although the apparatus has two discharge ports, the single discharge tray can receive sheets discharged from the discharge ports, because the discharge tray can be moved by the moving means. Therefore, it is possible to provide an image forming apparatus which can be produced in a simple configuration and at a low cost.

In a second aspect of the invention, the image forming apparatus is characterized in that the discharge port of the first conveying path and the discharge port of the second conveying path are vertically arranged on a side of the image forming apparatus, and the moving means moves the discharge tray up and down.

According to the second aspect of the invention, since the discharge tray can be moved up and down by the moving means, sheets can be received by the discharge tray in a stacked manner and with aligning the ends. Furthermore, it is possible to increase the number of sheets which can be housed.

In a third aspect of the invention, the image forming apparatus is characterized in that a plurality of discharge trays are disposed.

According to the third aspect of the invention, sheets can be received by the plurality of discharge trays. Therefore, sheets can be received by the plurality of discharge trays with being sorted, irrespective of the conditions that the sheets are discharged with directing their front faces upward or downward.

In a fourth aspect of the invention, the image forming apparatus further comprises:

an arm member which is supported by an axis at a position higher than the discharge port of the first conveying path disposed at a position higher than the discharge port of the second conveying path, and which abuts against an upper face of a sheet placed on the discharge tray;

a first sensor for detecting the arm member abutting against an upper face of a sheet discharged from the discharge port of the first conveying path; and a second sensor which detects the arm member abutting against an upper face of a sheet discharged from the discharge port of the second conveying path, wherein the moving means, when a sheet is discharged from the discharge port of the first conveying path, moves the discharge tray to a position where the arm member is detected by the first sensor, and when a sheet is discharged from the discharge port of the second conveying path, moves the discharge tray to a position where the arm member is detected by the second sensor.

According to the fourth aspect of the invention, when a sheet is discharged from the discharge port of the first conveying path, the discharge tray is moved to a position where the arm member is detected by the first sensor, and, when a sheet is discharged from the discharge port of the second conveying path, the discharge tray is moved to a position where the arm member is detected by the second sensor. Although the apparatus has two discharge ports, therefore, the single discharge tray can surely receive sheets discharged from the discharge ports. Consequently, it is possible to provide an image forming apparatus which can be produced in a simple configuration and at a low cost.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
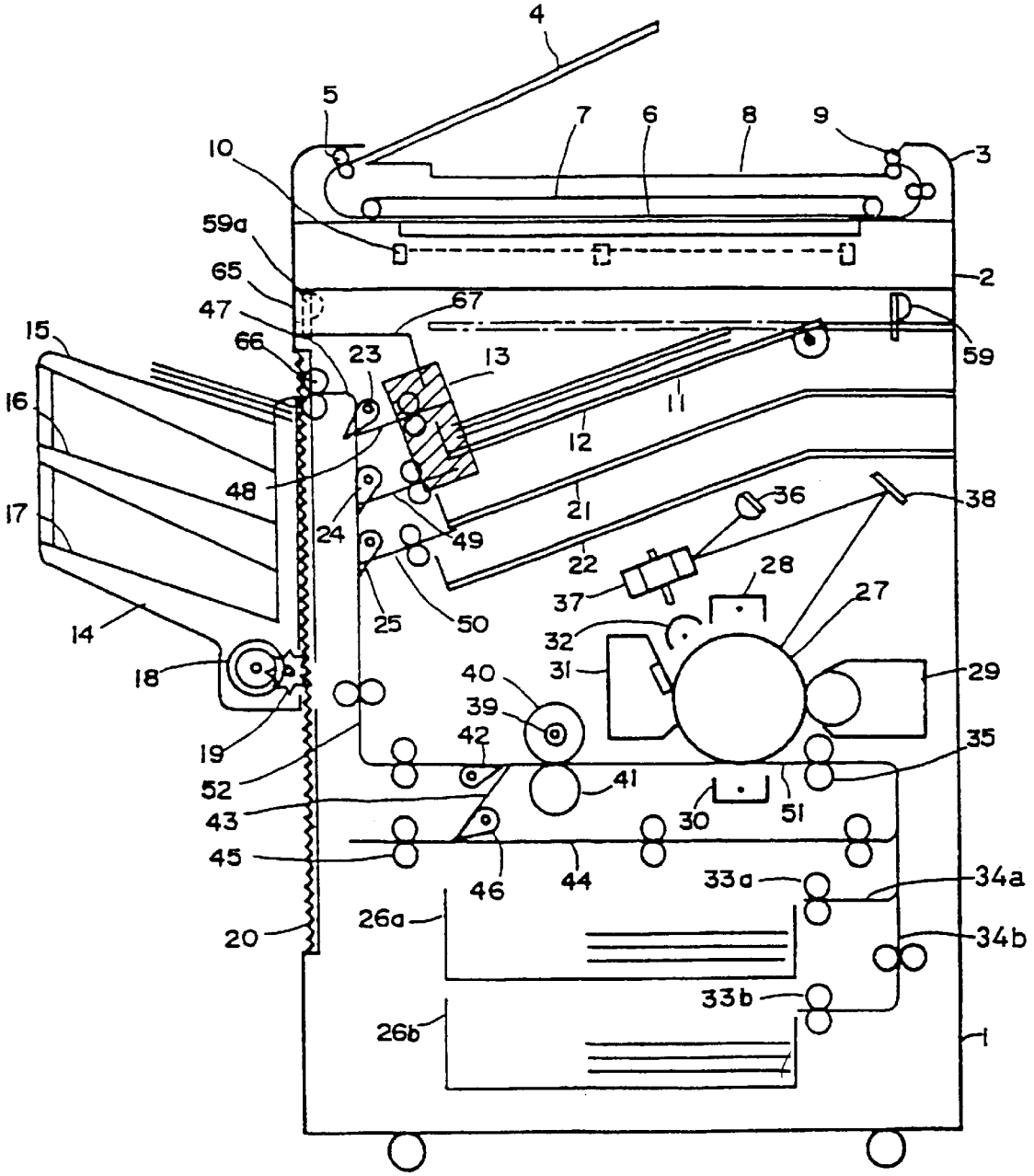
FIG. 1 is a side view showing an embodiment of an image forming apparatus of the invention.

Now referring to the drawings, preferred embodiments of the invention are described below.

An embodiment of an image forming apparatus of the invention will be described with referring to the accompanying drawings.

FIG. 1 is a view showing the configuration of an image forming apparatus which is an embodiment of the invention. An exposing and reading section 2 is disposed in an upper portion of an image forming apparatus main unit 1. An original feeder 3 is disposed above the exposing and reading section 2.

The original feeder 3 includes: an original supply tray 4 on which a bundle of originals can be placed; an original supply roller 5 which supplies the originals on the original supply tray 4 with separating from each other or one by one; an original conveying belt 7 which conveys an original to an original glass 6 which will be described later, and sets the original thereon; an original discharge tray 8 on which an original having undergone exposure is placed; and an original discharge roller 9 which discharges an original having undergone exposure to the original discharge tray 8.

The exposing and reading section 2 includes the original glass 6 on which an original is placed, and a CCD sensor 10 which can be reciprocally moved with respect to an original placed on the original glass 6. In response to an exposure start signal, the exposing and reading section 2 causes the CCD sensor 10 to perform a scanning operation to read an image of the original.

A post-processing section 11 is disposed under the exposing and reading section 2. The post-processing section 11 includes: a post-processing tray 12 which is inclined with setting the sheet entering side to be lower; and a stapler 13 which staples sheets placed on the post-processing tray 12.

A discharge tray unit 14 which is inclined with setting the sheet entering side to be lower, and which can be moved up and down is disposed on a side (the left side in FIG. 1) of the image forming apparatus main unit 1. The discharge tray unit 14 includes three trays 15, 16, and 17. The discharge tray unit 14 can be moved up and down by transmitting a forward or backward driving force of a motor 18 disposed in the discharge tray unit 14, via a gear 19 to a rack 20 disposed on the side of the image forming apparatus main unit 1.

A facsimile discharge tray 21 and a printer discharge tray 22 are disposed below the post-processing section 11. Switching gates 23, 24, and 25 which are used for switching over trays receiving a discharged sheet in respective modes which will be described later are disposed.

Sheet cassettes 26*a* and 26*b* for housing sheets on which an image is formed are disposed in a lower portion of the image forming apparatus main unit 1.

An image forming section is disposed in the center portion of the image forming apparatus main unit 1. The image forming section is configured by components which are arranged around a photosensitive drum 27, namely, a charging device 28, a developing device 29, a transferring device 30, a cleaning device 31, and a discharging device 32.

In this configuration, the image forming operation is conducted in the following steps.

First, each sheet housed in the sheet cassette 26*a* (26*b*) is separately supplied by sheet supply rollers 33*a* (33*b*), and then conveyed to a registration roller pair 35 through a sheet conveying path 34*a* (34*b*) by the respective conveying rollers.

The photosensitive drum 27 is uniformly charged by the charging device 28, and then exposed by laser light emitted from a laser oscillation device 36 via a polygon mirror 37 which is rotated at a high speed and a mirror 38, thereby forming an electrostatic latent image. The latent image is developed as a toner image by the developing device 29. A sheet which is conveyed from the sheet cassette 26*a* (26*b*) is sent between the transferring device 30 and the photosensitive drum 27 by the registration roller pair 35, at a timing when the sheet coincides with the toner image with respect to their positions, and then the toner image is transferred to the sheet. Toner which is not transferred is removed from the photosensitive drum 27 by the cleaning device 31, and surface charges of the photosensitive drum 27 are eliminated by the discharging device 32.

A sheet to which the toner image has been transferred is passed through a heat roller pair consisting of an upper heat roller 40 which incorporates a heating lamp 39, and a lower pressure roller 41 which is pressurized by the upper heat roller 40 to be driven to rotate, thereby fixing the toner image to the sheet. In this way, the image formation on the sheet is completed.

A sheet which has undergone the image formation is caused by a reverse gate 42 to be conveyed to a reverse conveying path 43, or to be conveyed to a conveying path 52 through which a sheet is conveyed to the post-processing section 11, the discharge tray unit 14, the discharge tray 21 or 22.

The reverse conveying path 43 joins a conveying path 44. A sheet conveyed to the reverse conveying path 43 is once conveyed in the leftward direction in FIG. 1 by a reverse conveying roller pair 45 which can be rotated forward and backward. When a switchback gate 46 is switched over, the reverse conveying roller pair 45 is backward rotated while interposing the sheet so that the sheet is switched back to be conveyed into the conveying path 44. As a result, the sheet is reversed, and then conveyed to the registration roller pair 35 as it is.

When a sheet which has undergone an image formation is caused by the reverse gate 42 to be conveyed to the conveying path 52, the switching gates 23, 24, and 25 are switched over in accordance with the current mode of the image formation so that the sheet is conveyed to one of the following paths: a first conveying path 47 leading to the discharge tray unit 14; a second conveying path 48 leading to the post-processing section 11; a third conveying path 49 leading to the facsimile discharge tray 21; and a fourth conveying path 50 leading to the printer discharge tray 22.

In the apparatus, an image is formed in accordance with an image signal produced by a facsimile reception, an image signal supplied from a host computer, or an image signal produced by the exposing and reading section 2 incorporated in the apparatus.

The image formation using an image signal produced by a facsimile reception is performed in the following manner. In accordance with the image signal, laser light is oscillated from the laser oscillation device 36 as described above, and an electrostatic latent image is formed on the photosensitive drum 27. In the image forming section, on a conveying path 51 where an image is formed, an image is formed on a sheet with upward directing the image forming face. Thereafter, the sheet is conveyed by the functions of the switching gates 24 and 25 into the facsimile discharge tray 21 via the conveying path 51 so as to be placed thereon with downward directing the image forming face of the sheet.

An image formation using an image signal supplied from the host computer is performed in a similar manner. In this case, the sheet is conveyed by the function of the switching gate 25 into the printer discharge tray 22 through the conveying path 52 so as to be placed on the tray with downward directing the image forming face. In the case where an image formation of N pages is performed on the basis of an image signal produced by a facsimile reception and an image signal supplied from the host computer, the image signal is usually transmitted in the sequence of the first page to the N-th page. Therefore, the image formation is performed in this sequence. In the above-mentioned facsimile and printer discharge trays 21 and 22, sheets are stacked from the first page with downward directing the image forming face. In other words, sheets are stacked in a correct page sequence.

Furthermore, in the apparatus, post-processing can be performed after the image formation using an image signal produced by a facsimile reception and supplied from the host computer. In the same manner as described above, sheets are conveyed to the post-processing tray 12 serving as means for stacking a plurality of sheets. In this case, sheets are conveyed through the conveying path 52 to the second conveying path 48 leading to the post-processing tray 12, by the functions of the switching gates 23, 24, and 25. In order to produce a sheet bundle in which sheets are stapled in a correct page sequence, it is required only to, after the sheets are stacked on the post-processing tray 12, staple the sheets as they are by the stapler 13.

Figure 2:
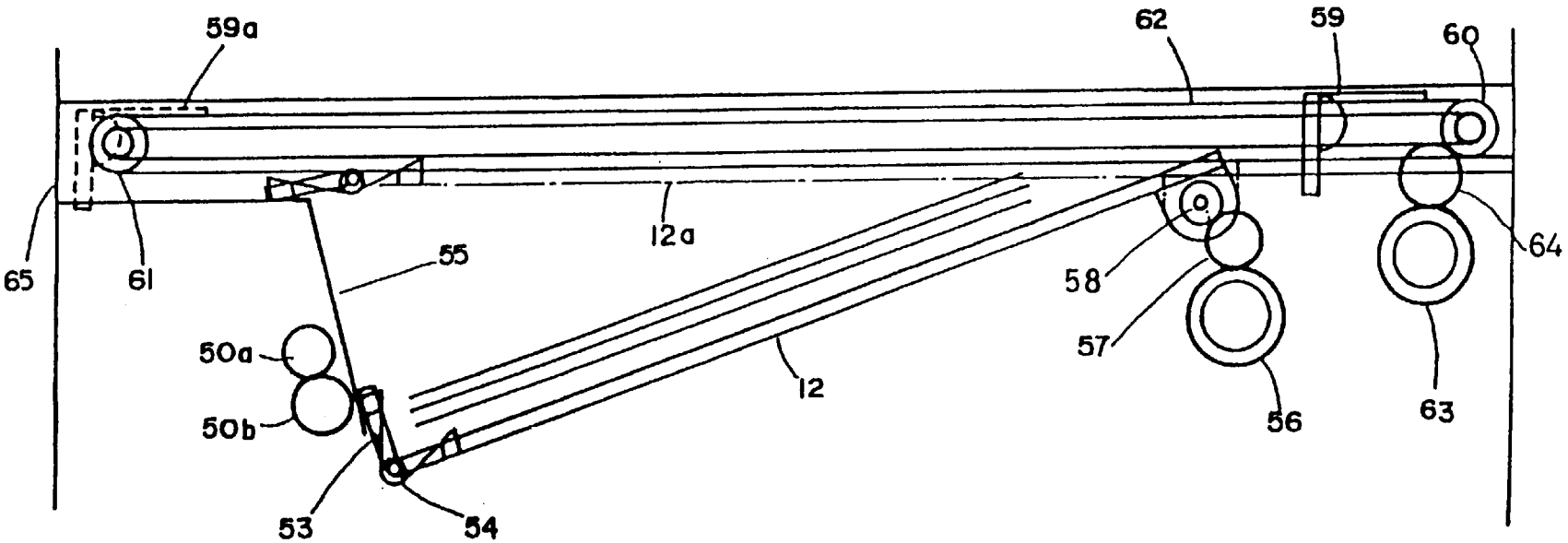
FIG. 2 is a side view showing a post-processing section of FIG. 1.

Referring to FIG. 2, the second conveying path 48 through which a bundle of sheets stacked on the post-processing tray 12 is conveyed to the discharge tray unit 14 will be described.

Since the post-processing tray 12 is inclined, sheets which are conveyed through the second conveying path 48 to the post-processing tray 12 by a conveying roller pair 50*a* and 50*b* are caused by gravity to abut against an end guide 53 of the post-processing tray, so that their ends are aligned.

The end guide 53 of the post-processing tray is attached in a rotatable manner to the tip end of the post-processing tray 12, and urged in a counterclockwise direction by a spring 54. The urging force makes the end guide 53 abut against a tray-opposing face 55 of the post-processing section 11. After an operation of stapling sheets is completed, the post-processing tray 12 is driven via a gear 57 by a post-processing tray swinging motor 56 so that the tray and the obtained sheet bundle are lifted about a post-processing tray shaft 58 to a horizontal position 12*a* which is indicated by the one-dot chain line in the figure. When the post-processing tray 12 is swung to reach the horizontal position 12*a*, the end guide 53 loses the abutting face to be swung by the urging force of the spring 54, with the result that the guide abuts against the conveying face extending in the horizontal direction.

A mechanism of operating a pusher 59 will be described. The pusher 59 is fixed to a belt 62 which runs between a driving pulley 60 and a tension pulley 61. The pusher can be horizontally moved by driving the belt 62. When the movement of the post-processing tray 12 to the horizontal position 12*a* is completed, a pusher motor 63 for moving the pusher 59 rotates the driving pulley 60 via the gear 64, thereby driving the belt 62.

The pusher 59 for pushing out the sheet bundle placed on the post-processing tray 12 is moved from a retraction position (the pusher 59 indicated by the solid line) which is on the right side of the post-processing tray 12, to a discharge completion position (the pusher 59*a* indicated by the broken line) which is on the left side of the post-processing tray 12, so as to push the rear end of the sheet bundle. As a result, the sheet bundle is pushed out from a discharge port 65 to the discharge tray unit 14.

When an image formation is performed on the basis of an image signal produced by the exposing and reading section 2 incorporated in the apparatus, the apparatus is used as a copier.

A case where M sets of image formation are performed on originals of N pages and sheets are not stapled will be described. In this case, the originals of N pages are placed on the original supply tray 4 of the original feeder 3, and the originals are sent one by one to the exposing and reading section 2 in the sequence of the N-th page to the first page. Images of the originals of the N-th page to the first page are converted into image signals by the exposing and reading section 2, and the image signals are once stored in a mass storage device (such as a large-capacity RAM, a hard disk drive or the like). The image signals are then sent in the sequence of the N-th page to the first page from the mass storage device to the laser oscillation device 36. Electrostatic latent images are formed on the photosensitive drum 27 by laser light and then transferred to sheets. Sheets to which the images are transferred are conveyed through the first conveying path 47 and discharged via a discharge roller pair 66 to the discharge tray 15. In this case, the sheets are stacked in the sequence of the N-th page to the first page with upward directing the image forming face of each sheet. When the first set is completed, the second set is processed in the same manner. Namely, the image signals are sent from the mass storage device to the laser oscillation device 36, and the formed images are transferred to sheets. The sheets of the second set are stacked on those of the first set which are stacked on the discharge tray 15. This operation is repeated so that M sets of sheets which are not stapled are conveyed to the discharge tray 15.

Next, a case where M sets of image formation are performed on originals of N pages and sheets are stapled will be described. In the same manner as the above-described case, the originals of N pages are placed on the original feeder 3, and the images of the originals of the N-th page to the first page are once stored in the mass storage device. The developed images are transferred to sheets in the sequence of the first page to the N-th page. Sheets to which the images are transferred are conveyed through the second conveying path 48 to the post-processing tray 12. In this case, the sheets are stacked in the sequence of the first page to the N-th page with downward directing the image forming face of each sheet. When the first set is completed, the sheets are stapled by the stapler 13. A sheet bundle in which the sheets are stapled in a correct page sequence is pushed out by the pusher 59 from the discharge port 65 to the discharge tray unit 14, through a fifth conveying path 67 which is formed above the first conveying path 47. As a result, the sheet bundle is placed on the discharge tray unit 14.

Thereafter, the second set is processed in the same manner. Namely, the image signals are sent from the mass storage device to the laser oscillation device 36, and the formed images are transferred to sheets. The sheets of the second set are stacked on the post-processing tray 12 that becomes empty. The sheets are then stapled and placed on the discharge tray unit 14. This operation is repeatedly performed on M sets of sheets, thereby completing the process.

In this method also, sheets of the first page to the N-th page are not required to be switched back one by one. Even when the image formation is continuously performed, the image forming speed can be improved, because a wasteful time period, i.e., the time period for the switchback operation can be eliminated.

The discharge of sheets onto the discharge tray unit 14 is conducted in either of the following two methods. In a method which is performed when sheets are not stapled, the sheets are discharged from the discharge roller pair 66 through the first conveying path 47. In the other method which is performed when sheets are stapled, the sheets are discharged by the pusher 59 from the discharge port 65 through the fifth conveying path 67. The discharge roller pair 66 is located at a lower position than the discharge port 65, so that sheets are discharged from positions of different heights. Consequently, sheets may fail to be finely stacked on the discharge tray unit 14, with the result that the stacked sheets crumble down.

Figure 3:
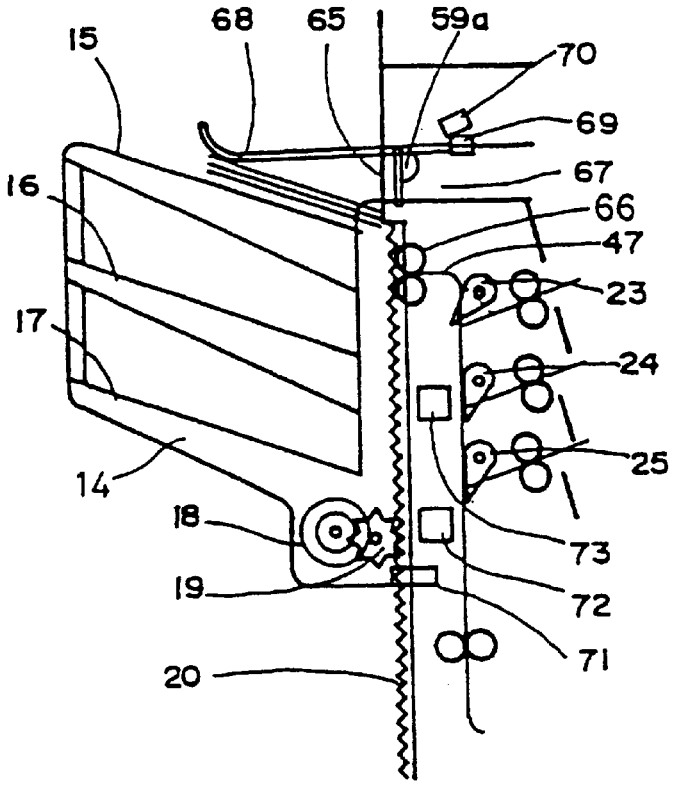
FIG. 3 is a side view showing a state in which a sheet is discharged from a discharge port of FIG. 1 to a tray of an upper stage of a discharge tray unit.
Figure 4:
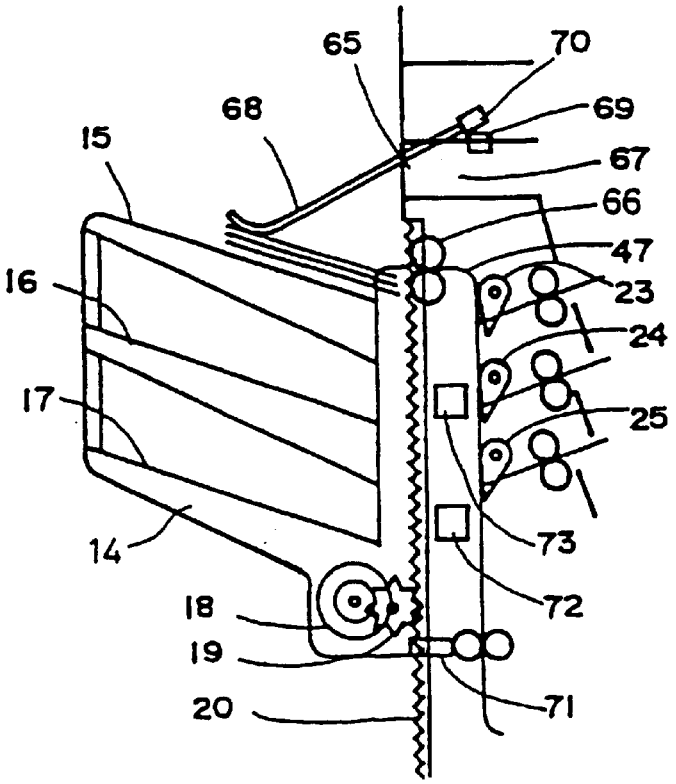
FIG. 4 is a side view showing a state in which a sheet is discharged from a discharge roller pair of FIG. 1 to the tray of the upper stage of the discharge tray unit.

To comply with this, the embodiment is configured in the following manner. In order to move the tray 15 of the discharge tray unit 14 to an appropriate height with respect to the discharge port 65, as shown in FIGS. 3 and 4, the embodiment comprises: a sheet-upper-face detecting arm 68 which is supported by an axis above the discharge port 65; a sheet-upper-face detecting sensor 69 which detects the position of the upper face of a sheet discharged from the discharge port 65; and an upper-face-position detecting sensor 70 which detects the position of the upper face of a sheet discharged by the discharge roller pair 66.

The weight distribution in the sheet-upper-face detecting arm 68 is adjusted so that the arm rotates in a counterclockwise direction. When sheets are discharged by the pusher 59 from the discharge port 65 through the fifth conveying path 67, the position of the discharge tray unit 14 is vertically controlled so that the sheet-upper-face detecting arm 68 is detected by the sheet-upper-face detecting sensor 69, whereby the discharge tray unit 14 is moved to a position (see FIG. 3) opposed to the discharge port 65.

When sheets are discharged from the discharge roller pair 66 through the first conveying path 47, the position of the discharge tray unit 14 is vertically controlled so that the sheet-upper-face detecting arm 68 is detected by the upper-face-position detecting sensor 70, whereby the discharge tray unit 14 is moved to a position (see FIG. 4) opposed to the discharge roller pair 66.

According to this configuration, the discharge tray unit 14 receives sheets at either of positions respectively opposed to the discharge port 65 and the discharge roller pair 66 that are disposed in the upper portion of the apparatus. Therefore, the discharged position is also located at a high level, and hence the embodiment has advantages that discharged sheets can be easily visually recognized and the removal of the sheets can be easily performed.

In the configuration where the discharge tray unit 14 provided with the function of vertical movement can be located at a high level, the vertical movement can have a sufficient stroke. In accordance with the vertical movement stroke, therefore, a very large number of sheets can be stacked. This large number of stackable sheets results in that, even when the image formation is continuously performed at many times, a case where the discharge tray becomes full and the operation of the apparatus is stopped does not occur. Furthermore, a cumbersome work in which the user checks the amount of sheets discharged to the discharge tray unit 14 can be eliminated.

Figure 5:
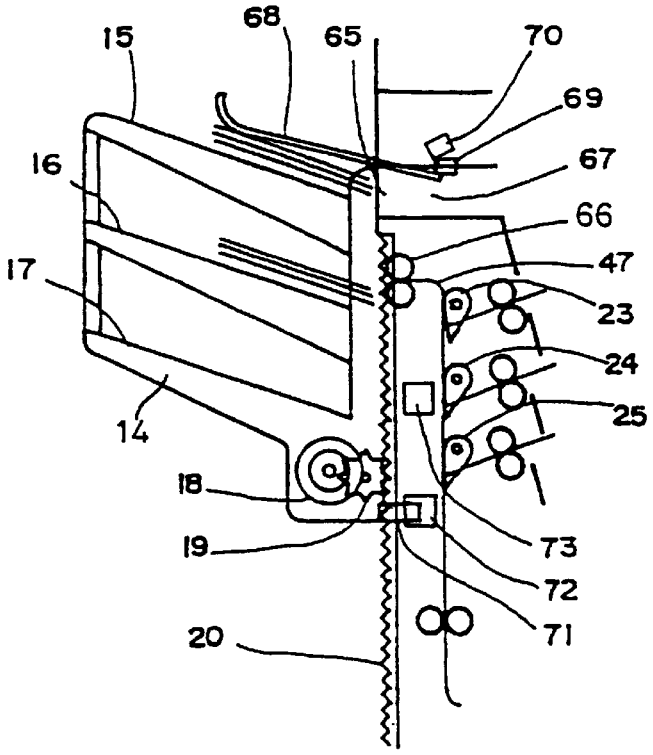
FIG. 5 is a side view showing a state in which a sheet is discharged from the discharge roller pair of FIG. 1 to a tray of a middle stage of the discharge tray unit.
Figure 6:
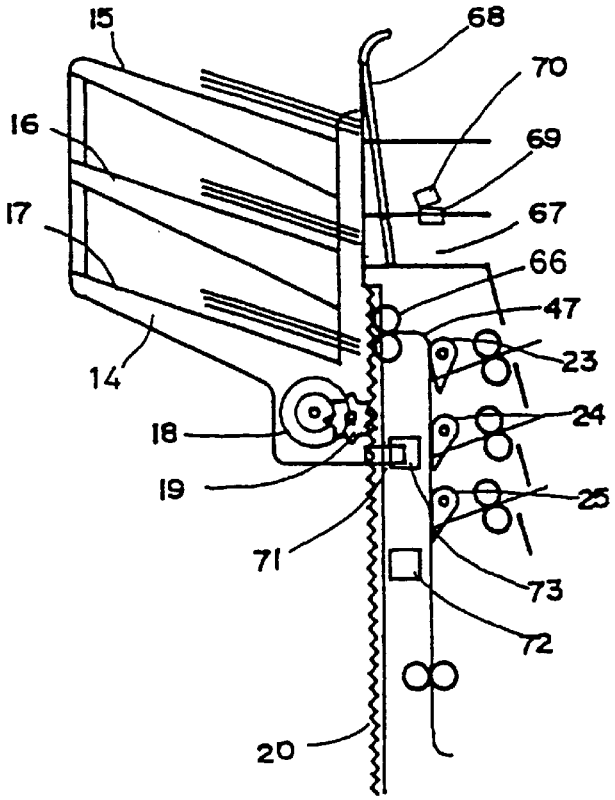
FIG. 6 is a side view showing a state in which a sheet is discharged from the discharge roller pair of FIG. 1 to a tray of a lower stage of the discharge tray unit.
Figure 7:
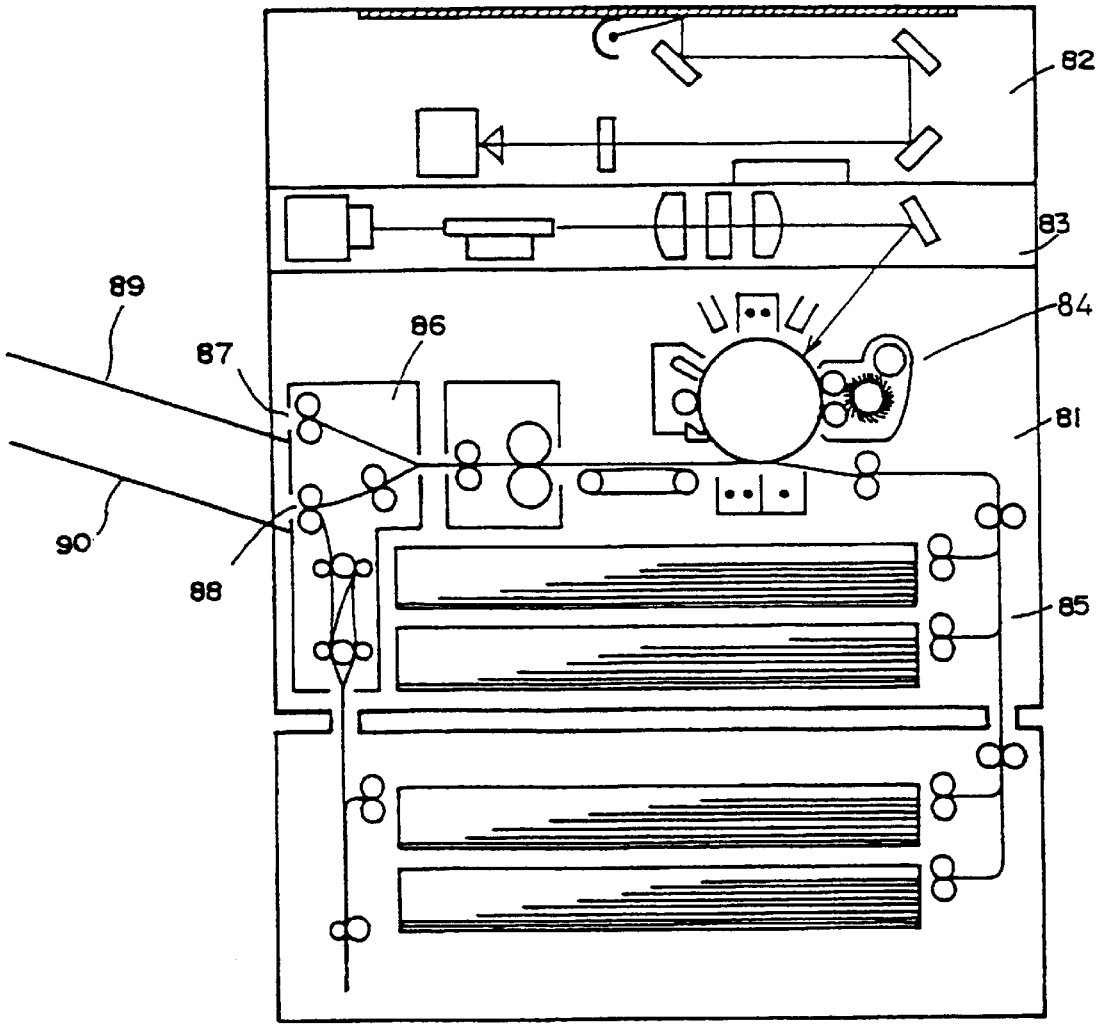
FIG. 7 PRIOR ART
FIG. 7 is a side view showing a first example of an image forming apparatus of the prior art.
Figure 8:
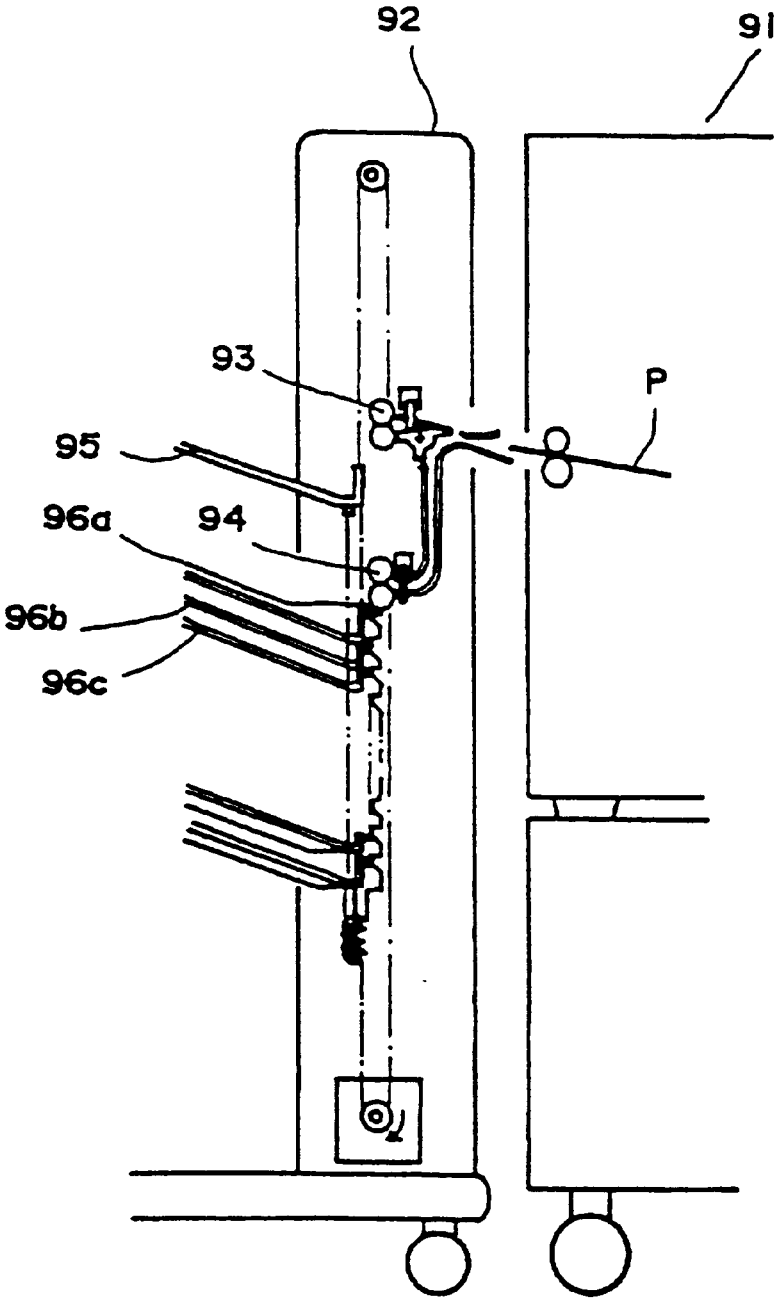
FIG. 8 PRIOR ART
FIG. 8 is a side view showing a second example of an image forming apparatus of the prior art.

The trays 15, 16, and 17 of the discharge tray unit 14 may be used as shown in FIGS. 5 and 6. In this case, as shown in FIG. 5, when the tray 16 receives sheets discharged from the discharge roller pair 66 through the first conveying path 47, a discharge tray unit height detecting plate 71 is disposed to the discharge tray unit 14, and a height detecting sensor 72 which, when the tray 16 reaches a position opposed to the discharge roller pair 66, detects the discharge tray unit height detecting plate 71 is disposed to the image forming apparatus main unit 1. The discharge tray unit 14 is controlled so that the vertical movement is stopped at a position where the height detecting sensor 72 detects the discharge tray unit height detecting plate 71.

When the tray 17 receives sheets discharged from the discharge roller pair 66 through the first conveying path 47, the discharge tray unit height detecting plate 71 is disposed to the discharge tray unit 14, and a height detecting sensor 73 which, when the tray 17 reaches the position opposed to the discharge roller pair 66, detects the discharge tray unit height detecting plate 71 is disposed to the image forming apparatus main unit 1. The discharge tray unit 14 is controlled so that the vertical movement is stopped at a position where the height detecting sensor 73 detects the discharge tray unit height detecting plate 71.

In order to receive a bundle of reversed sheets with setting the tray 16 or 17 so as to be opposed to the discharge port 65, a sensor which detects the discharge tray unit height detecting plate 71 corresponding to the level of the discharge tray unit 14 may be disposed in the same manner as described above.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image forming section for forming an image on a sheet;

a discharge tray for receiving the sheet on which an image is formed;

a first conveying path for guiding the sheet from the image forming section to the discharge tray so as to place the sheet on the discharge tray with directing an image forming face of the sheet in one of upward and downward directions;

a second conveying path for reversing the sheet to guide from the image forming section to the discharge tray so as to place the sheet on the discharge tray with directing the image forming face in the direction opposite to the direction in which the first conveying path guides the sheet to the discharge tray; and switching means for switching over the first conveying path and the second conveying path, the apparatus further comprising moving means for moving the discharge tray between a position where a sheet discharged from a discharge port of the first conveying path is received, and another position where a sheet discharged from a discharge port of the second conveying path is received.

2. The image forming apparatus of claim 1, wherein the discharge port of the first conveying path and the discharge port of the second conveying path are vertically arranged on a side of the image forming apparatus, and the moving means moves the discharge tray up and down.

3. The image forming apparatus of claim 1, wherein a plurality of discharge trays are disposed.

4. The image forming apparatus of claim 2, further comprising:

an arm member which is supported by an axis at a position higher than the discharge port of the first conveying path disposed at a position higher than the discharge port of the second conveying path, and which abuts against an upper face of a sheet which is placed on the discharge tray;

a first sensor for detecting the arm member abutting against an upper face of a sheet discharged from the discharge port of the first conveying path; and a second sensor for detecting the arm member abutting against an upper face of a sheet discharged from the discharge port of the second conveying path, wherein the moving means, when a sheet is discharged from the discharge port of the first conveying path, moves the discharge tray to a position where the arm member is detected by the first sensor, and when a sheet is discharged from the discharge port of the second conveying path, moves the discharge tray to a position where the arm member is detected by the second sensor.

5. The image forming apparatus of claim 2, wherein a plurality of discharge trays are disposed.

* * * * *